United States Patent [19]

Decker, II

[11] 4,003,310

[45] Jan. 18, 1977

[54] CONTROL APPARATUS FOR GRIPPER FINGER SHAFT FOR PRINTING PRESS

[75] Inventor: Charles E. Decker, II, Canton, Ohio

[73] Assignee: The Dillon Electric & Machine Co., Canton, Ohio

[22] Filed: May 7, 1975

[21] Appl. No.: 575,411

[52] U.S. Cl. ..... 101/411; 271/277

[51] Int. Cl.[2] ..... B41F 1/30; B41F 21/04

[58] Field of Search ..... 101/408, 409, 410, 411; 74/57; 271/82, 277

[56] References Cited

UNITED STATES PATENTS

| | | | |
|---|---|---|---|
| 503,713 | 8/1893 | Blake | 101/411 |
| 508,053 | 11/1893 | Scott | 101/411 |
| 612,705 | 10/1898 | Clark | 101/411 |
| 979,845 | 12/1910 | Guillo | 101/411 |
| 1,225,670 | 5/1917 | McCain | 101/411 |
| 1,593,236 | 7/1926 | Barber | 101/411 |
| 1,874,013 | 8/1932 | Kaddeland | 101/411 X |
| 2,002,853 | 5/1935 | Eckhard | 101/411 |
| 2,747,417 | 5/1956 | Brown | 74/57 |
| 3,080,765 | 3/1963 | Eisele | 74/57 |
| 3,406,625 | 10/1968 | Chamness et al. | 74/57 X |
| 3,628,645 | 12/1971 | McFeaters et al. | 74/57 X |
| 3,874,394 | 4/1975 | Robertson | 101/425 X |

*Primary Examiner*—Edgar S. Burr
*Assistant Examiner*—Paul J. Hirsch
*Attorney, Agent, or Firm*—Oldham & Oldham Co.

[57] ABSTRACT

In a printing press having a conventional plate cylinder and an impression cylinder operatively positioned on a frame with the impression cylinder having gripper fingers and a gripper finger positioning shaft, the improvement relating to a tumbler member secured to one end of the gripper finger shaft and having pin receiving recess means formed in such tumbler member. A pair of fluid-actuated independently controlled cylinders are provided at the end of the impression cylinder whereby when the cylinders are actuated the piston rods extend therefrom for engagement with the tumbler member to turn it and its associated shaft through an arc by rotation of the impression cylinder for controlling the operative and inoperative positioning of the gripper fingers on the gripper finger shaft.

5 Claims, 4 Drawing Figures

CONTROL APPARATUS FOR GRIPPER FINGER SHAFT FOR PRINTING PRESS

BACKGROUND OF INVENTION

Heretofore there have been many different kinds of printing presses provided and the present invention is illustrated with relation to a two revolution hand feed sheet fed gravure press for multi-color printing from flat copper plates or the like. Such a press is especially adapted for proofing and short run gravure printing.

Printing presses very similar to that of the present invention were made in the early 1900's by Linotype & Machinery, Ltd., of London, England. Such prior types of printing presses were fully mechanically controlled and operated. These prior printing presses of the same type as those of the present invention involved relatively heavy moving parts, substantially all of the control functions thereof were driven or obtained from the operative drive of the machine and the press, as a whole, was difficult to operate and not convenient to use, to control, or to repair. Patents in the name of Frank Hyman were believed to have been issued on the prior press many years ago. Production of such presses terminated some years ago.

The general object of the present invention is to provide a new and improved printing press, and especially to provide a fluid actuated means for controlling the position and action of the gripper fingers on the impression roll.

Another object of the invention is to provide a printing press wherein two independently actuated cylinder, piston and piston rod means are provided for positioning piston rods in operative and inoperative positions re control of the gripper fingers on the impression cylinder.

Another object of the invention is to provide relatively lightweight, easily actuated members having positively actuated control means provided therefor for controlling the paper gripping and release action of gripping fingers on the impression cylinder.

The foregoing and other objects and advantages of the invention will be made more apparent as the specification proceeds.

In the accompanying drawings.

When referring to corresponding members shown on the drawings and referred to in this specification, corresponding numerals are used to facilitate comparison therebetween.

SUBJECT MATTER OF THE INVENTION

This invention relates to an improvement in a printing press having a standard plate cylinder, impression cylinder, gripper finger shaft and gripper fingers provided therein and with improvement relating to a tumbler member secured to one end of the gripper finger shaft, which tumbler member, as one embodiment of the invention, has an exposed side face at the end of the impression cylinder and having a pin receiving recess formed in such side face and extending the length thereof, and a pair of fluid-actuated cylinders having pistons therein and piston rods extending therefrom, the cylinders and piston rods being so positioned as to engage the tumbler member when a piston rod is extended to turn it and its associated shaft through an arc by rotation of the impression roll to control the action of the gripper fingers in the press.

Figure 1:
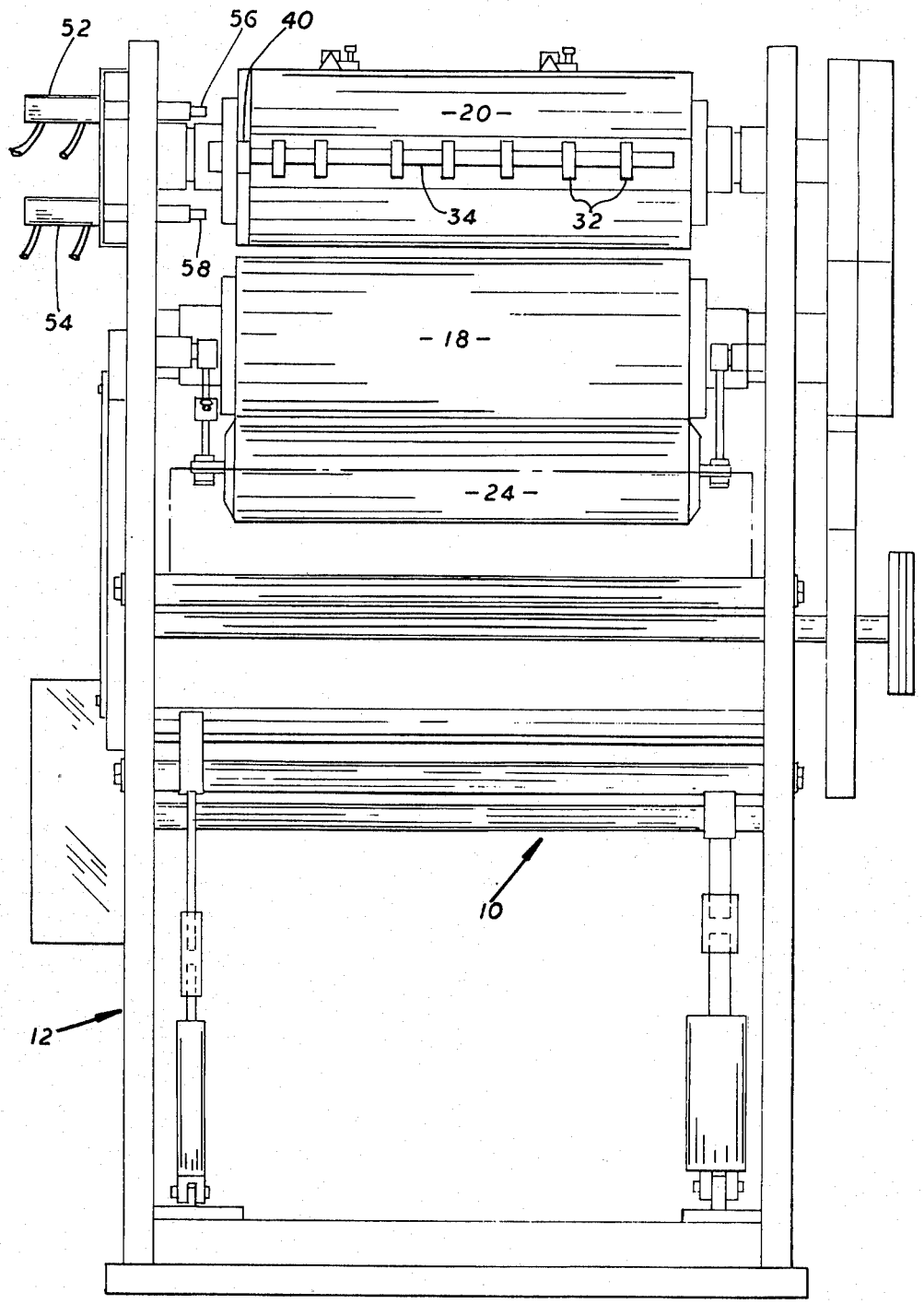
FIG. 1 is a front end elevation of the printing press of the invention with a portion of the feeder mechanism thereof being omitted for clarity.
Figure 2:
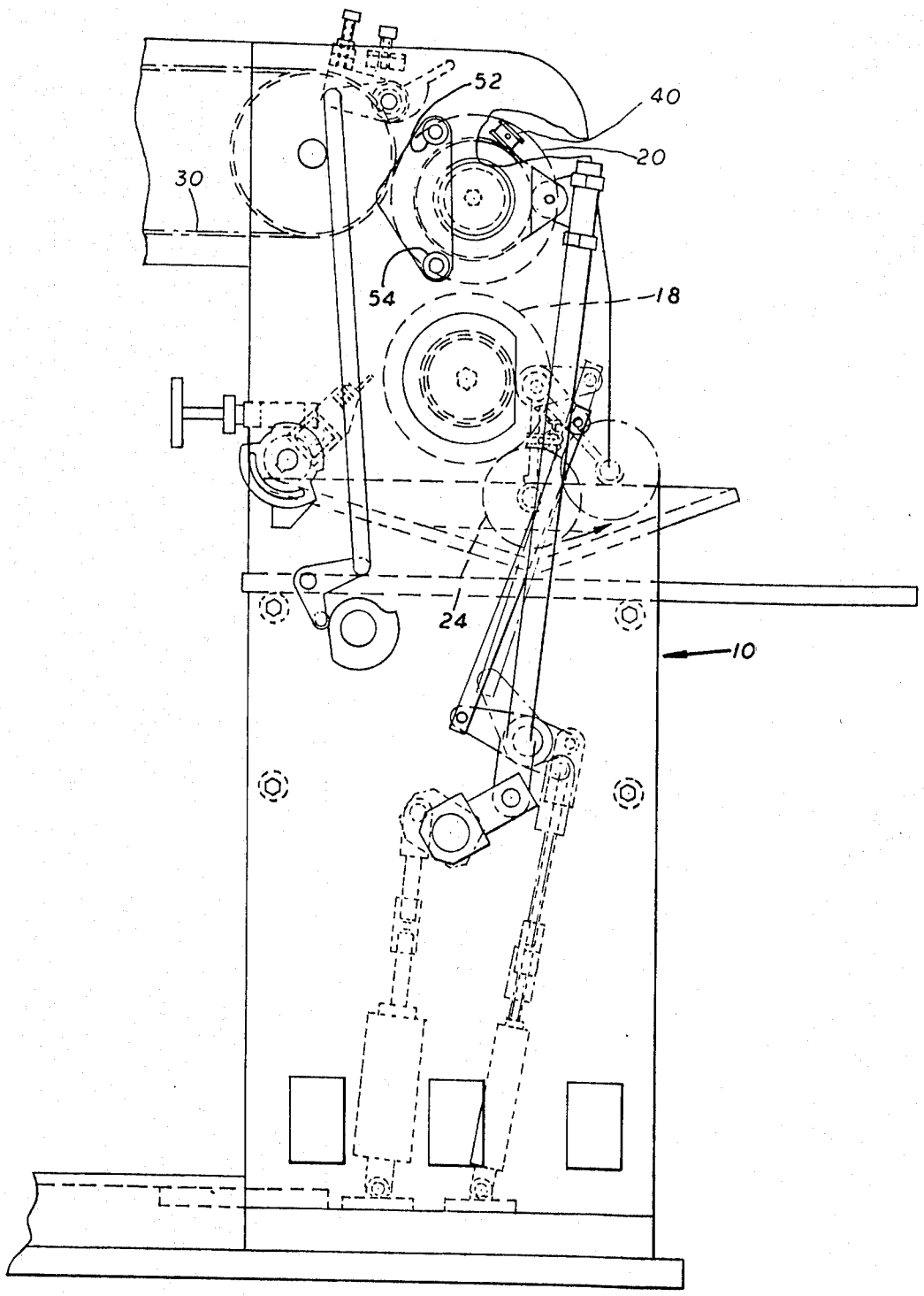
FIG. 2 is a side elevation of the press of FIG. 1 with a portion of the frame being removed to show other portions of the press.

Reference now is made to the details of a printing press indicated as a whole by the number 10 a primary portion of which is shown in FIG. 1 of the drawings. Usually the press of the invention is a two revolution hand feed gravure press for proofing and short run gravure printing. The press 10 includes a suitable frame means 12 on which the various operative parts of the press are positioned. This printing press 10 includes a plate cylinder 18, an inking roll 24 and an impression cylinder 20. These cylinders are driven in conventional or known manners. The press is designed to transfer the sheet receiving an impression when positioned on the impression cylinder 20 to a transfer and drying conveyor 30, a portion of which is shown in the drawings. In general, the means on the impression cylinder 20 for grasping paper sheets, and including gripper fingers 32 and a gripper finger positioning shaft 34 are of conventional construction. This gripper finger shaft 34 has a tumbler member or device 40, FIG. 2, secured to one end thereof at one side of the frame and this tumbler member has recess means formed at opposite ends thereof such as a pin receiving recess 42 extending the length thereof in an exposed side face of the tumbler.

As indicated in the drawings, this recess 42 is formed by opposed substantially parallel edge sections or ribs of the tumbler, and the recess 42 is so shaped that it flares outwardly at wall portions 44 and 46 at one end of the tumbler, whereas the recess is slightly narrower in width at its opposite end wall portions 48 and 50. The connecting wall portions of the tumbler recess are separated enough to let a control pin or rod pass therethrough, as later described.

As an important feature of the invention, a pair of fluid-actuated cylinders 52 and 54 are positioned on the frame 12 adjacent the path of the tumbler 40 on the end of the impression cylinder 20. These cylinders have conventional pistons (not shown) positioned therein and controlling protruding piston rods 56 and 58, respectively, that normally extend through a portion of the frame 12, such as a side plate 14 thereof, and on which the cylinders 52 and 54 are suitably operatively positioned. The piston rods 56 and 58 and the controlled movement provided therefor by the cylinders 52 and 54 is such that the piston rods can be projected to extend into the path of movement of the tumbler 40 as it is rotated with the impression cylinder 20 in operation of the press to control paper gripping and release action.

Figure 3:
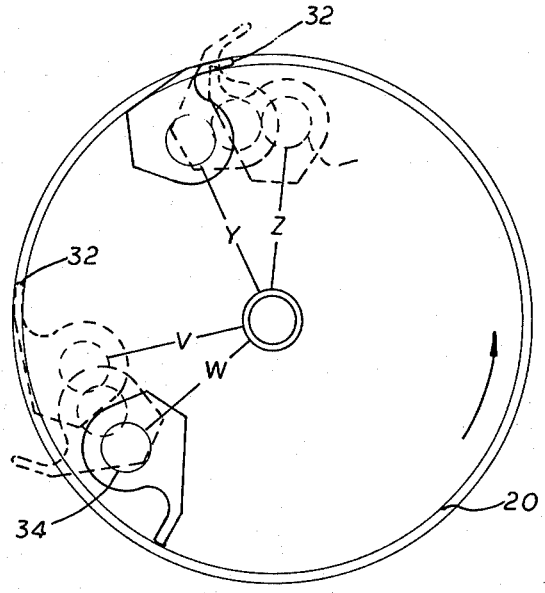
FIG. 3 is an enlarged end elevation of part of the impression cylinder assembly of the printing press.

FIG. 3 of the drawings indicates the operative movement of the gripper finger shaft 34 in moving the gripper fingers 32 from an initially open position to a closed position with short arcuate movement of the impression cylinder, while the figure also indicates the opening or release movement of the gripper fingers by controlled arcuate movement of the gripper finger shaft. The drawing shows the fingers 32 in dotted lines as the gripper shaft is at position Z and as the impression cylinder rotates the shaft to position Y, the fingers 32 in solid lines have been moved to closed or paper engaging position. Conventional means (not shown) aid in manual feed of the paper to the impression cylinder for grasp by the fingers 32. This action is obtained by the piston rod 56 engaging the tumbler 40 while the piston rod 58 provides a finger opening movement at the release station to move the fingers 32 from a dotted line closed position to a solid line open position as the cylinder 20 moves from position V to position W.

Figure 4:
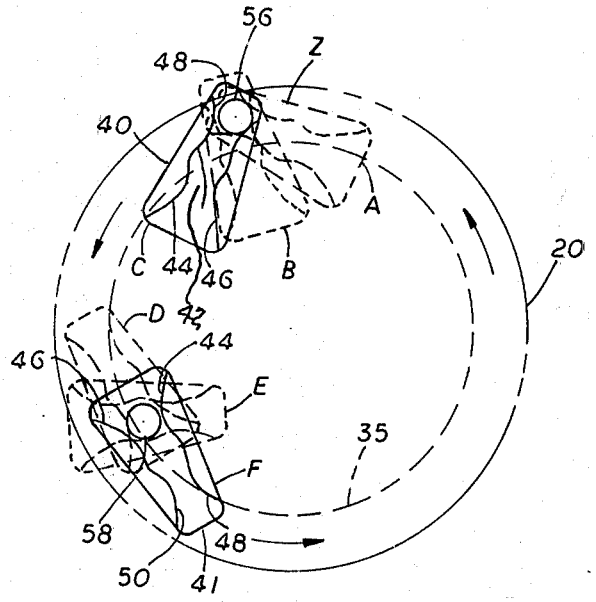
FIG. 4 is an enlarged elevation, partly diagrammatic, of the tumbler and impression cylinder assembly indicating the tumblers movements.

FIG. 4 of the drawings indicates the control action of the tumbler 40 and the relative position of the piston rod 56 of cylinder 52 when it is moved to its extended position to engage the recess 42 of the tumbler as the cylinder 20 rotates. Such piston rod 56 engages the then leading end of the tumbler formed by the end walls 48 and 50 and it rotates the shaft 34 as the cylinder 20 rotates to move the shaft and fingers 32 through an arc to grasp a paper sheet and position it on the cylinder 20 for a printing operation thereon. This piston rod 56 hence engages a short length of one or more end walls of the tumbler and turns the tumbler 40 clockwise from the gripper open position indicated in dotted lines at A through an arc and through the gripper finger position approaching a closed position indicated in solid lines at C. It should be noted that the piston rod 56 is positioned radially outwardly of the path of annular movement 35 of a gripper finger shaft on the impression cylinder and that the rod 56 only engages one end portion of the tumbler to rotate it over 90°. This piston rod 56 is only moved to its extended, operative position when the impression cylinder is ready to receive a sheet for printing action. Promptly after actuation of the gripper finger shaft 34 by the piston rod 56, it is moved to its retracted position. Then in accordance with the printing practice of this press, the sheet of paper must be carried through more than one revolution by the impression cylinder 20 to receive the impression thereon and be ready to have the sheet of paper released. At such time, approximately one and one quarter revolutions after the gripper fingers have been moved to a closed position, the second cylinder 54 is actuated and the piston rod 58 is moved to its extended position. This position is slightly radially within the circle of movement of the gripper finger shaft. At that time, the opposite end of the tumbler 40 having end walls 44 and 46 is the leading end of the tumbler. Thus as the impression cylinder moves to bring the piston rod 58 into engagement with the recess 42, the gripper fingers are moved from their closed operative positions by a short arcuate movement of the gripper finger shaft 34 in a counterclockwise direction by the tumbler 40 moving from its dotted line position D to its solid line position F, FIG. 4. This returns the narrow portion of the recess 42 and the end 41 of the tumbler to a leading position with relation to the rotation of the impression cylinder. The tumbler 40 next is presented for control action in the dotted line position A of FIG. 4. The piston rod 58 again has just entered an end of the recess 42, engaged portions of the recess walls and then exited from the same end of the recess due to the rotation of the tumbler over 90°.

The actuation of the cylinders 52 and 54 is controlled by suitable means that operate in timed relationship to rotation of the impression cylinder. The controls are such as to move the piston rods 56 and 58 into and out of operative association with the tumbler in desired timed relationship to the rotation of the impression cylinder. Preferably the cylinders 52 and 54 are pneumatically operated and thus suitable sources of compressed air for supply of air to opposite ends of the cylinders for positive advancing and retraction of the piston rods thereof are provided. Controls, such as rotary cams positioned in a control box driven correspondingly to the drive of the printing press, may be used. But an independent control shut-off is provided for the cylinders 52 and 54 so that the gripper fingers will not operate at all times that the press operates. Hence, the press, printing cylinder, etc. can be cleaned when the press is in operation without movement of the gripper fingers. Also, the press can be operated in an idle condition (no output) to keep the ink from drying and the gripper fingers and shaft and tumbler be inoperative at such time.

By the use of the fluid-actuated cylinders 52 and 54 for controlling the tumbler opening and closing members, independent control of the gripper fingers on the impression cylinder is provided, and these control means are relatively light in weight and positive in action. Thus, a very effective control has been provided for the paper release and paper engaging actions in the press.

It will be understood that as the paper having the printed impressions implanted thereon is released by the gripper fingers 32, then other known gripper means associated with the drying conveyor 30 will engage the paper sheet for transfer to the next portion of the printing press for the drying and final deposit action on the paper sheet. Thus, it is believed that the objects of the invention have been achieved in providing an improved control apparatus for the gripper means on the impression cylinder.

While one complete embodiment of the invention has been disclosed herein, it will be appreciated that modification of this particular embodiment of the invention may be resorted to without departing from the scope of the invention.

What is claimed is:

1. In a printing press including a frame, a plate cylinder, a driven impression cylinder having a gripper finger shaft with gripper fingers, a tumbler secured to one end of the gripper finger shaft, the improvement comprising said tumbler having pin receiving recess means on one side thereof at each of its ends, and a pair of fluid actuated cylinders having piston rods operated thereby and extending from said cylinders, said cylinders and piston rods being so positioned adjacent an end of the impression cylinder as to engage said tumbler when a said piston rod is extended to turn it and its associated shaft through an arc by rotation of said impression roll but with said piston rods turning said tumbler in opposite directions.

2. In a printing press as in claim 1, and including control means for actuating said cylinders in timed relation to the drive of said impression cylinder for actuating one of said cylinders to move said gripper finger shaft in one direction to a closed or operative position for its fingers, and for actuating the second of said cylinders over one revolution later to move said gripper finger shaft through an arc to move its fingers from operative position to an open position, said control means extending said piston rods for only limited arcuate movement of said impression cylinder less than a revolution thereof.

3. In a printing press including a frame, a plate cylinder and an impression cylinder having gripper fingers and a gripper finger shaft, the improvement comprising a tumbler member secured to one end of the gripper finger shaft, said tumbler member having one exposed side face and having a pin receiving recess formed in said side face and extending the length of said tumbler, and a pair of fluid actuated cylinders having pistons therein and piston rods connected to said pistons extending from said cylinders which are mounted on said frame, said cylinders and piston rods being positioned to have a piston rod engage said recess in said tumbler member when a said piston rod is extended to turn said tumbler member and its associated shaft through an arc by rotation of said impression roll.

4. In a printing press as in claim 3, and including control means for actuating said cylinders in timed relation to the drive of said impression cylinder for actuating one of said cylinders to move said gripper finger shaft to a closed position for said fingers, and for actuating the second of said cylinders over one revolution later to move said gripper finger shaft through an arc in one direction to move said fingers from closed operative position to an open or release position.

5. In a printing press as in claim 4, where said cylinders are radially offset from the circle of rotation of said gripper finger shaft, and said piston rods individually engage said tumbler member to rotate it and said gripper finger shaft in different directions by the different piston rods.

* * * * *